United States Patent [19]

Carini

[11] Patent Number: 4,459,212

[45] **Date of Patent: * Jul. 10, 1984**

[54] PROCESS FOR WASTE ENCAPSULATION

[75] Inventor: Pietro T. Carini, Horgen, Switzerland

[73] Assignee: The Dow Chemical Company, Midland, Mich.

[ * ] Notice: The portion of the term of this patent subsequent to Jul. 10, 2001 has been disclaimed.

[21] Appl. No.: 376,467

[22] Filed: May 10, 1982

[51] Int. Cl.[3] ..... G31F 9/16

[52] U.S. Cl. ..... 210/751; 252/628; 252/631

[58] Field of Search ..... 210/729–732, 210/751; 252/628, 631

[56] References Cited

U.S. PATENT DOCUMENTS 4,077,901 3/1978 Arnold et al. ..... 252/628

*Primary Examiner*—Ivars C. Cintins

*Attorney, Agent, or Firm*—B. M. Kanuch

[57] ABSTRACT

An improvement in the process of encapsulating aqueous liquid waste materials in liquid thermosettable resins of the group consisting of vinyl ester resins, unsaturated polyester resins, and mixtures thereof by forming an emulsion of such waste materials in said resins, which comprises increasing the amount of waste material incorporated in a given amount of resin by incorporating in the waste-resin emulsion a water-soluble salt of carboxymethyl cellulose.

6 Claims, No Drawings

PROCESS FOR WASTE ENCAPSULATION

BACKGROUND OF THE INVENTION

A major environmental problem centers around the disposal of various waste materials. These include radioactive wastes from nuclear fission processes, and particularly low level wastes such as those obtained from the aqueous evaporators in a nuclear power plant, used ion-exchange resins and filter materials such as clays and diatomaceous earth. These wastes may be in the form of aqueous solutions or slurries. Other problem wastes are those obtained as by-products from various chemical operations, such as electroplating solutions, by-products from insecticide manufacturing plants, and the like.

One method of disposing of these wastes is to incorporate them in materials such as cement or urea formaldehyde resins, solidifying the mixture and burying the blocks thus made in approved burial sites. Some of the shortcomings of this particular process are described in U.S. Pat. No. 4,077,901. This same patent describes one solution which has proven to be quite satisfactory, namely, the encapsulation of these waste materials in vinyl ester resins or in unsaturated polyester resins or in mixtures of these two types of resins.

The problem of waste disposal has intensified due to the costs of the encapsulating materials, extreme difficulty in obtaining burial space, and the criticality of effecting uniform encapsulation of radioactive waste materials so as to avoid hot spots which lead to increased transportation and burial costs of such encapsulated wastes. Added to the foregoing is the increased complexity and variety of aqueous liquid wastes.

THE INVENTION

The present invention is an improvement in the encapsulation of aqueous liquid waste materials in liquid, thermosettable resins of the group consisting of vinyl ester resins, unsaturated polyester resins or mixtures of these resins. This improvement comprises the addition, during the encapsulation process, of a water-soluble salt of carboxymethyl cellulose. The purpose of adding the carboxymethyl cellulose (often referred to herein as "CMC") is to increase the amount of waste material encapsulated in a given amount of resin. Such additive also permits the encapsulation of slurries with high solids content.

The encapsulation process using the above-noted resins is described in U.S. Pat. No. 4,077,901 and comprises the uniform dispersion of the waste material in the liquid thermosettable resin. The water-soluble salt of carboxymethyl cellulose may be added to the waste material or to the liquid, thermosettable resin prior to forming the waste-resin dispersion.

DESCRIPTION OF THE INVENTION

The present invention is an improvement in the process described in detail in U.S. Pat. No. 4,077,901, as that process is applied to aqueous liquid waste materials. The disclosure of U.S. Pat. No. 4,077,901 is fully incorporated herein by reference. The process of said patent comprises the making of waste material-resin emulsions by blending resins, as defined in the patent, with aqueous liquid wastes. The resins used in the process are liquid thermosettable resins which include vinyl ester resins, unsaturated polyester resins and mixtures of these resins. The vinyl ester resins that may be employed are more particularly defined in the claims as liquid thermosettable resin compositions of (1) a vinyl ester resin prepared by reacting about equivalent proportions of an unsaturated monocarboxylic acid and a polyepoxide resin, said vinyl ester resin containing

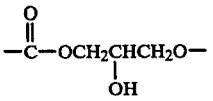

linkage groups and terminal vinylidene groups attached to the ester end of said linkage or (2) an unsaturated polyester or (3) mixtures thereof, and a catalyst for curing said resin. When aqueous wastes are involved, the composition is cured under thermal and catalytic conditions such that the exotherm developed during the cure never rises above the temperature at which the integrity of the encapsulating material is destroyed. Vinyl ester resins are further described in U.S. Pat. Nos. 3,367,992; 3,066,112; 3,179,623; 3,301,743; and 3,256,226.

Preferably, the thermosettable resin phase comprises from 40 to 70 weight percent of the vinyl ester or polyester resin and from 60 to 30 percent of a copolymerizable monomer. Suitable monomers must be essentially water insoluble to maintain the monomer in the resin phase in the emulsion, although complete water insolubility is not required and a small amount of monomer dissolved in the emulsified water does no harm.

Suitable monomers include vinyl aromatic compounds such as styrene, vinyl toluene, divinyl benzene, and the like, and the saturated alcohols such as methyl, ethyl, isopropyl, octyl, etc., esters of acrylic acid or methacrylic acid; vinyl acetate; diallyl maleate; dimethallyl fumarate; mixtures of the same and all other monomers which are capable of copolymerizing with the vinyl ester resin and are essentially water insoluble.

Still another group of vinyl ester resins that may be employed are those modified by reaction with dicarboxylic acid anhydrides.

The unsaturated polyester resins that may be used in the process are described in column 3 of U.S. Pat. No. 4,077,901. Such polyesters are made by reacting ethylenically unsaturated dicarboxylic acids or anhydrides with an alkylene glycol or polyalkylene glycol having a molecular weight of up to about 2,000.

Mixtures of the vinyl ester and the unsaturated polyester resins may be employed.

In practicing the method of the invention covered by U.S. Pat. No. 4,077,901, a free radical yielding catalyst is blended with the resin and the waste material is then dispersed in the resin under conditions to form a uniform emulsion. The wastes treatable according to the present invention are aqueous liquids, either as solutions or slurries, which form water-in-oil type emulsions. In such instances, the aqueous waste is added to the liquid uncured resin under shearing conditions to form the emulsion. While the shear conditions may be widely varied, generally with aqueous liquid wastes, sufficient shear should be applied to produce a relatively uniform emulsion of small droplet size. The water-in-oil emulsion should have sufficient storage stability to last at least through the initial gelation of the resin. The emulsions made with the vinyl ester resins, particularly those previously described, generally exhibit adequate stability without added emulsifier. Emulsions made with unsaturated polyester resins may require the addition of a water-in-oil emulsifier.

Catalysts that may be used for the curing or polymerization are preferably the peroxide and hydroperoxide catalysts such as benzoyl peroxide, lauroyl peroxide, t-butyl hydroperoxide, methyl ethyl ketone peroxide, t-butyl perbenzoate, potassium persulfate and the like. The amount of catalyst added will vary preferably from 0.1 to about 5 percent by weight of the resin phase. Additional catalyst may be required for certain wastes.

Preferably, the cure of the emulsion can be initiated at room temperature by the addition of known accelerating agents or promoters, such as lead or cobalt naphthenate, dimethyl aniline, N,N-dimethyl-p-toluidine and the like, usually in concentrations ranging from 0.1 to 5.0 weight percent. The promoted emulsion can be readily gelled in about 3 to 15 minutes, depending on the temperature, the catalyst level and the promoter level; and cured to a hard solid in about one hour.

It is important in the process of encapsulating aqueous liquid wastes that the conditions of selection of catalyst, catalyst concentration and promoter selection and concentration be such that the exotherm does not rise above the temperature at which the integrity of the encapsulating material will be destroyed.

The improvement of the present invention resides in the discovery that many aqueous liquid wastes which are difficult to encapsulate in the resins described in U.S. Pat. No. 4,077,901, or which can be emulsified in such resins only in relatively small amounts, can be readily emulsified in such resins in substantial amounts by adding a water-soluble salt of carboxymethyl cellulose during the encapsulation process.

The commercial products, generally referred to in the literature as CMC, are the sodium salts of carboxymethyl groups substituted on the cellulose molecule. There is a theoretical maximum of three hydroxyl groups in the cellulose molecule that may be so substituted, but CMC having a degree of substitution ranging from about 0.65 to about 1.2 is preferred in the present invention. CMC having a lower degree of substitution does not appear to be as effective as CMC having a degree of substitution in the preferred range. CMC having a high degree of substitution tends to produce a highly viscous emulsion and is difficult to handle during the encapsulation or emulsification process. Similarly, CMC in the high molecular weight range (700,000) produces highly viscous emulsions and is difficult to use.

In practicing the improved process comprising this invention, the water-soluble salt of carboxymethyl cellulose or CMC may be incorporated in the waste or in the resin prior to forming the waste-resin emulsion. It is preferred to add the CMC to the resin for at least two reasons. First, the addition of CMC to water-containing materials tends to increase the viscosity of the mixture. With most waste materials tested, the addition of the CMC to the resin phase produces more uniform, lower viscosity dispersions and better encapsulation. Secondly, exposure to the radioactive waste is avoided.

The CMC is not soluble in the resin phase, so that the addition of the CMC to the resin must be accomplished along with sufficient stirring to obtain a uniform dispersion of the CMC throughout the resin. Normally, the CMC will be added as a dry powder to the resin.

Verification or test runs are generally made to determine optimum amounts of CMC that will enable the maximum amount of aqueous liquid waste to be emulsified in a given amount of resin. Emulsions made of aqueous liquid waste materials and resins are usually of a creamy consistency. When the amount of waste added exceeds the ability of the resin to incorporate the waste in the emulsion, this produces water streaks (actually long thin lines of liquid waste) which swirl about the vortex created by the stirrer. These streaks are of a different consistency from the rest of the emulsion and sometimes of a different color. Once these water streaks appear, the addition of more CMC usually will not cause them to disappear.

Consequently, optimum amounts of CMC can be determined for each waste only by the addition of some estimated amount of CMC to the aqueous waste or to the resin, but preferably to the resin. This procedure is continued with separate samples of waste and resin, and increasing amounts of CMC until the maximum amount of waste that a given amount of resin can encapsulate has been reached. For economic reasons it is desirable that the volume of waste to resin should be at least about 1.0 to 1.5 parts of waste to 1.0 part of resin. The amount of CMC required to achieve such a ratio may range from about 0.10 to 15 percent by weight based on the weight of resin. The preferred range varies from about 0.25 percent to about 8.0 percent by weight of CMC based on the weight of the resin.

When the ratio of waste to resin approaches the range of 1.5:1 to 2:1, it is desirable to run actual qualifying tests. This is because the addition of CMC tends to mask the true end point (maximum amount of waste that can be added to a given amount of resin) at these higher waste to resin ratios. This masking effect can be resolved by the addition of catalyst and promoter and subsequent determination whether a solid block is obtained, free from surface water, wherein the aqueous liquid waste is completely encapsulated in the resin.

It should be noted that the addition of water-soluble salts of carboxymethyl cellulose to the waste-resin dispersion does not adversely affect the amount of catalyst or promoter that is required for effective cure of the resin, nor does it adversely affect the exothermic temperature produced during such cure beyond that for which one skilled in the art can easily make appropriate adjustments.

One major advantage of the use of CMC in the process disclosed in U.S. Pat. No. 4,077,901 is the significant increase in the amount of aqueous liquid waste that can be encapsulated in a given amount of resin. Still another advantage is the discovery that certain slurries having a percent solids content as high as 85% that heretofore could not be encapsulated can now be encapsulated using the present process.

The method of the present invention is illustrated in the following Examples which include certain comparative runs illustrative of the prior art, and where:

(1) Resin A is a fluid thermosettable resin which is prepared by reacting (by weight) 32.6 parts of the diglycidyl ether of bisphenol A extended with 8.7 parts of bisphenol A; then reacted with 1.2 parts maleic anhydride and 7.5 parts methacrylic acid, the resin dissolved in 50 parts styrene.

(2) Resin B is a fluid thermosettable polyester resin obtained from Interplastics Corp., under the trade designation COREZYN 158-5. Additional styrene was added to bring the styrene concentration to 40 percent of the total resin.

(3) Catalyst is 40 percent benzoyl peroxide emulsified in diisobutyl phthalate obtained from Noury Chemical Corp. under the trade designation CADOX 40E.

(4) Promoter is N,N-dimethyl-p-toluidine.

(5) CMC is the water-soluble sodium salt of carboxymethyl cellulose having a degree of substitution of 0.65 to 0.90, medium viscosity and a molecular weight in the range of 250,000, obtained from Hercules Chemical Co. under the designation "CMC-7M".

EXAMPLE 1

A simulated aqueous liquid waste slurry was prepared by mixing uniformly the following solids in the amounts shown in water:

| | |
|---|---|
| Powdered Ion Exchange Resin (Cation) | 2,000 gms |
| Powdered Ion Exchange Resin (Anion) | 2,000 gms |
| Filter Precoat (Cellulosic Material) | 1,000 gms |
| Used Turbine Oil | 150 gms |
| Water | 10,000 gms |
| (approximately 85% apparent solids) | |

Encapsulation of the slurry was attempted using the following formulations 1A and 1B representing prior art and differing only in respect to the quantity of waste slurry added:

| Formulation | 1A | 1B |
|---|---|---|
| Resin A | 100 mls | 100 mls |
| Slurry | 45 mls | 75 mls |
| Catalyst | 2.5 mls | 2.5 mls |
| Promoter | 0.15 ml | 0.15 ml |

In formulation 1A, the slurry was added to the Resin A with rapid stirring to maintain a vortex in the center of the stirred mixture. Initial addition of the slurry produced an off-white, water-in-oil emulsion which increased in viscosity as the slurry was added. After 45 milliliters of slurry were added, liquid (water) streaks were noted in the emulsion. Addition of the slurry was then discontinued, and the catalyst and then the promoter were added.

Following the addition of the promoter and catalyst, the emulsion gelled in less than 8 minutes and reached a peak temperature of 100° C. in about 1 hour producing a tan, hard block.

The procedure above described was followed with respect to the formulation 1B, except that the addition of the slurry was continued until 75 milliliters of slurry were added. Water streaks were observed. After the catalyst and the promoter were added, a hard solid block was not obtained. Free water was observed on the top of the block that was obtained and the block itself had the appearance of swiss cheese.

EXAMPLE 2

Using the simulated waste slurry of Example 1, the following formulations incorporating CMC were prepared by mixing ingredients in the order listed:

| Formulation | Ex. 2A | Ex. 2B |
|---|---|---|
| Resin A | 100.0 mls | 100.0 mls |
| CMC | 4 gms | 4 gms |
| Slurry | 167 mls | 167 mls |
| Catalyst | 2.5 mls | 2.5 mls |
| Promoter | 0.15 ml | 0.15 ml |

Example 2A was prepared by adding CMC in the form of a white powder to Resin A with stirring until the CMC was thoroughly dispersed. Then, slurry was added until 167 mls had been incorporated in the resin. After the slurry addition was completed, the catalyst and then the promoter were added with stirring. The emulsion gelled in approximately 3 minutes and reached a peak temperature of 53° C. within one hour. A tan, hard solid block was obtained with no free liquid being in visual evidence.

In Example 2B, the CMC was added to the waste slurry with stirring. This mixture was then added with stirring to the Resin A. An off-white, viscous emulsion equivalent to that of Example 2A resulted. The catalyst and then the promoter were subsequently added and the emulsion stirred for 1 to 2 minutes. The emulsion gelled in 5 minutes and reached a peak temperature of 65° C. within one hour. A tan, hard solid was achieved again without evidence of free liquid when visually examined.

In comparing Example 2A with 2B, it was noted that the addition of the CMC to the waste in Example 2B took much more time and was more difficult than addition of CMC to Resin A in Example 2A.

EXAMPLE 3

A simulated aqueous liquid waste slurry was prepared by making up a 30 percent by weight solution of sodium nitrate in water. This waste included 0.1 percent kerosene. The sodium nitrate impurities approximated 5 percent and included metallic impurities such as aluminum, calcium, chromium, copper, iron and potassium, and organic impurities such as oxalates, tartrates and citrates. Encapsulation of this slurry was attempted using the following formulations 3A and 3B:

| | 3A | 3B |
|---|---|---|
| Resin A | 50 mls | 50 mls |
| CMC | 0 | 2 gms |
| Slurry | 67 mls | 90 mls |
| Catalyst | 2.5 mls | 2.5 mls |
| Promoter | 0.07 ml | 0.07 ml |

The procedures and order of mixing of Example 3A followed those detailed above in connection with Example 1A. Slurry was added until there was faint show of water streaks. Following the addition of the promoter and catalyst, the emulsion gelled in about 3 minutes and reached a peak temperature of 40° C. A good block free from surface water was obtained.

In Example 3B, CMC in the form of a white powder was first added to the Resin A with stirring. The subsequent procedures and order of mixing were identical to those used in Example 3A. With CMC addition, 90 milliliters of slurry could be incorporated in the resin before there was a show of a water streak. After the addition of the promoter and catalyst, the emulsion gelled in slightly over 5 minutes and reached a maximum temperature of 48° C. A hard block free from surface water was formed in less than one hour.

EXAMPLE 4

In order to determine the operability of a number of different CMC's, the sodium salts of the following carboxymethyl cellulose compounds were tested:

CMC-7M: Medium viscosity CMC having 0.7 degree of substitution and a molecular weight in the range of 250,000.

CMC-7M8S: Same as CMC-7M, but also that this CMC is one having 8,000 centipoise maximum viscosity in a 1% solution, and having smooth solution characteristics.

CMC-7LT: A low viscosity CMC having 0.7 degree of substitution and molecular weight in the range of 90,000.

CMC-7H4: A high viscosity CMC having 0.7 degree of substitution, a molecular weight in the range of 700,000 and 4,000 centipoise maximum viscosity in 1% solution.

CMC-9M8: A medium viscosity CMC having 0.9 degree of substitution, a molecular weight in the range of 250,000, and 8,000 centipoise maximum viscosity in a 1% solution.

CMC-12M8: Same as CMC-9M8 except that it has a degree of substitution of 1.2.

Using the procedures described above in Example 2A and the aqueous slurry of Example 1, 4 grams of each of the above CMC compounds were incorporated in 100 milliliters of Resin A with stirring; 174 milliliters of slurry were added to this mixture to produce a water-in-oil emulsion, followed by 2.5 milliliters of catalyst and 0.15 milliliter of promoter added and the formulation allowed to gel and form a solid block, with the results shown below:

| Example No. | CMC | Gel Time (Minutes) | Maximum Temperature (°C.) | Comments |
|---|---|---|---|---|
| 4A | 7M | 14 | 51 | All produced |
| 4B | 7M8S | 8.5 | 61 | good solid |
| 4C | 7LT | 12 | 55 | blocks free |
| 4D | 7H4 | 8 | 65 | from surface |
| 4E | 9M8 | 14 | 55 | water. |
| 4F | 12M8 | 7.5 | 61 | |

EXAMPLE 5

Using the procedures and formulations employed in Example 4A above, the amount of CMC-7M was varied with the following results:

| Example No. | Grams of CMC-7M | Gel Time (Minutes) | Maximum Temperature (°C.) | Comments |
|---|---|---|---|---|
| 5A | 0.5 | (Not measured) | | Poor block, free water |
| 5B | 1.0 | >30 | 40 | Good block, a little free water |
| 5C | 2.0 | 35.5 | (Not measured) | Good block, no free water |
| 5D | 3.0 | 17.5 | 55 | Good block, no free water |
| 5E | 4.0 | 14 | 51 | Good block, no free water |

EXAMPLE 6

A simulated, pressurized water reactor waste was prepared by mixing the following ingredients in the amounts shown in the weight of water designated:

| Ingredient | Amount in Grams |
|---|---|
| $Na_2B_4O_7.10H_2O$ | 83 |
| $H_3BO_3$ (Boric Acid) | 63 |
| $FeSO_4.7H_2O$ | 9.8 |

-continued

| Ingredient | Amount in Grams |
|---|---|
| $Na_3PO_4.12H_2O$ | 18 |
| $Na_2SO_4$ | 55 |
| Diatomaceous Earth | 18 |
| Water | 866.3 |

Encapsulation of this waste was then attempted in the following formulations:

| Formulation | 6A | 6B | 6C |
|---|---|---|---|
| Resin B | 50 mls | 50 mls | 50 mls |
| CMC | — | 2 gms | 2 gms |
| Waste | 49 mls | 80 mls | 95 mls |
| Catalyst | 1.2 mls | 1.2 mls | |
| Promoter | 0.05 ml | 0.05 ml | 0.05 ml |

The same procedures were followed with respect to Example 6A as were used in Example 1A. The only difference is that a different resin (Resin B) and a different waste were employed. Waste was added until a slight streaking was noticed. Following the addition of the catalyst and the promoter, the formulation gelled in 3 minutes 40 seconds, and reached a maximum temperature of 66° C. A good solid block was formed.

In Examples 6B and 6C, the same procedure was followed as in Example 2A. In Example 6B, the addition of the catalyst and promoter produced a gel in 2 minutes 20 seconds and a maximum temperature of 50° C. A good solid block was obtained that was free from water.

In Example 6C, the waste was added until some water streaking was apparent. The addition of catalyst and promoter produced a gel in 4 minutes 40 seconds and a maximum temperature of 68° C. A solid block was obtained, but there was a slight amount of free water.

It is apparent from Examples 6B and 6C above that the maximum amount of this waste that can be incorporated in 50 milliliters of Resin B using CMC lies somewhere between 80 and 95 milliliters.

What is claimed is:

1. In the process of encapsulating aqueous liquid wastes in liquid thermosettable resins of the group consisting of vinyl ester resins, unsaturated polyester resins and mixtures thereof, wherein the waste is emulsified in the resin, the improvement which comprises incorporating in the waste-resin emulsion a water-soluble salt of carboxymethyl cellulose in an amount sufficient to increase the amount of waste emulsified in the resin.

2. The process of claim 1 wherein the water-soluble salt of carboxymethyl cellulose has a degree of substitution ranging from about 0.65 to about 1.2.

3. The process of claim 2 wherein the carboxymethyl cellulose has a degree of substitution of about 0.7 and a molecular weight of approximately 250,000.

4. The process of claim 3 wherein the salt of the carboxymethyl cellulose employed is the sodium salt.

5. In the process of encapsulating aqueous liquid wastes in liquid thermosettable resins of the group consisting of vinyl ester resins, unsaturated polyester resins and mixtures thereof, wherein the liquid waste is emulsified in the resin, the improvement which comprises incorporating in the resin a sufficient amount of a water-soluble salt of carboxymethyl cellulose to substantially increase the amount of waste subsequently emulsified in the resin.

6. The process as defined in claim 5 wherein the salt of carboxymethyl cellulose is sodium and has a degree of substitution ranging from about 0.65 to about 1.2.

* * * * *

UNITED STATES PATENT AND TRADEMARK OFFICE

CERTIFICATE OF CORRECTION

PATENT NO. : 4,459,212

DATED : July 10, 1984

INVENTOR(S) : Pietro T. Carini

It is certified that error appears in the above-identified patent and that said Letters Patent is hereby corrected as shown below:

In Col. 8, line 15, (in the Table under 6C, opposite Catalyst) 1.2 mls was omitted.

Signed and Sealed this

*Twenty-sixth* Day of *February 1985*

[SEAL]

*Attest:*

DONALD J. QUIGG

*Attesting Officer* *Acting Commissioner of Patents and Trademarks*

Disclaimer and Dedication 4,459,212.—*Pietro T. Carini,* Horgen, Switzerland. PROCESS FOR WASTE ENCAPSULATION. Patent dated July 10, 1984. Disclaimer and Dedication filed Dec. 18, 1989, by the assignee, The Dow Chemical Company.

Hereby disclaims and dedicates to the Public all claims of said patent.

[*Official Gazette April 10, 1990* ]